United States Patent [19]

Qureshi

[11] 4,150,792

[45] Apr. 24, 1979

[54] RAIL FASTENER

[75] Inventor: Khurshid A. Qureshi, Bolingbrook, Ill.

[73] Assignee: Portec, Inc., Oak Brook, Ill.

[21] Appl. No.: 772,095

[22] Filed: Feb. 25, 1977

[51] Int. Cl.[2] ..... E01B 9/30; E01B 9/34

[52] U.S. Cl. ..... 238/349; 238/217; 238/338

[58] Field of Search ..... 238/217, 310, 315, 338, 238/341, 349, 351, 354, 317, 331, 333

[56] References Cited

U.S. PATENT DOCUMENTS

| | | | |
|---|---|---|---|
| 451,823 | 5/1891 | Johnson | 238/351 X |
| 1,422,340 | 7/1922 | Cooper et al. | 238/349 |
| 2,043,320 | 6/1936 | Delfox | 238/349 X |
| 3,067,947 | 12/1962 | Deenik et al. | 238/349 X |
| 3,442,452 | 5/1969 | Harmsen | 238/349 X |
| 3,451,621 | 6/1969 | DeSplinter | 238/349 X |
| 3,887,128 | 6/1975 | Ruble | 238/349 |
| 3,970,248 | 7/1976 | Molyneux | 238/349 |

FOREIGN PATENT DOCUMENTS

| | | | |
|---|---|---|---|
| 2305542 | 10/1976 | France | 238/349 |

*Primary Examiner*—Robert G. Sheridan
*Assistant Examiner*—Randolph A. Reese
*Attorney, Agent, or Firm*—Emory L. Groff, Jr.

[57] ABSTRACT

A rail fastener includes an anchor member fixed atop a crosstie and removably retaining a spring clip having a pair of spaced apart arms insertable within the anchor member. The spring clip, generally "C" shaped, has one of its arms deflected transversely and downwardly by a tapered retainer element on said anchor member whereby a positive downward force is applied by the other arm against a rail base flange. An abutment provided on the anchor member restricts vertical displacement of the other arm and rail base therebeneath.

16 Claims, 5 Drawing Figures

FIG. 1.
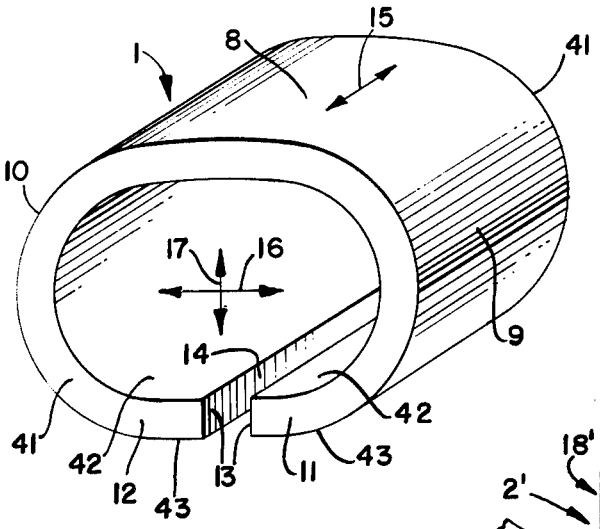
FIG. 2.
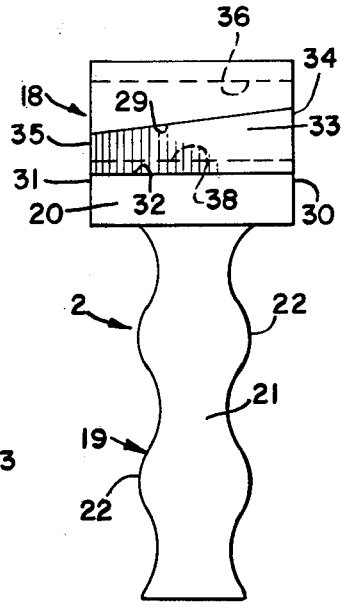
FIG. 4.
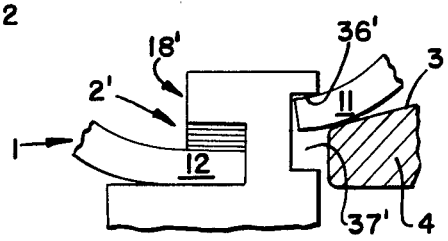
FIG. 3.
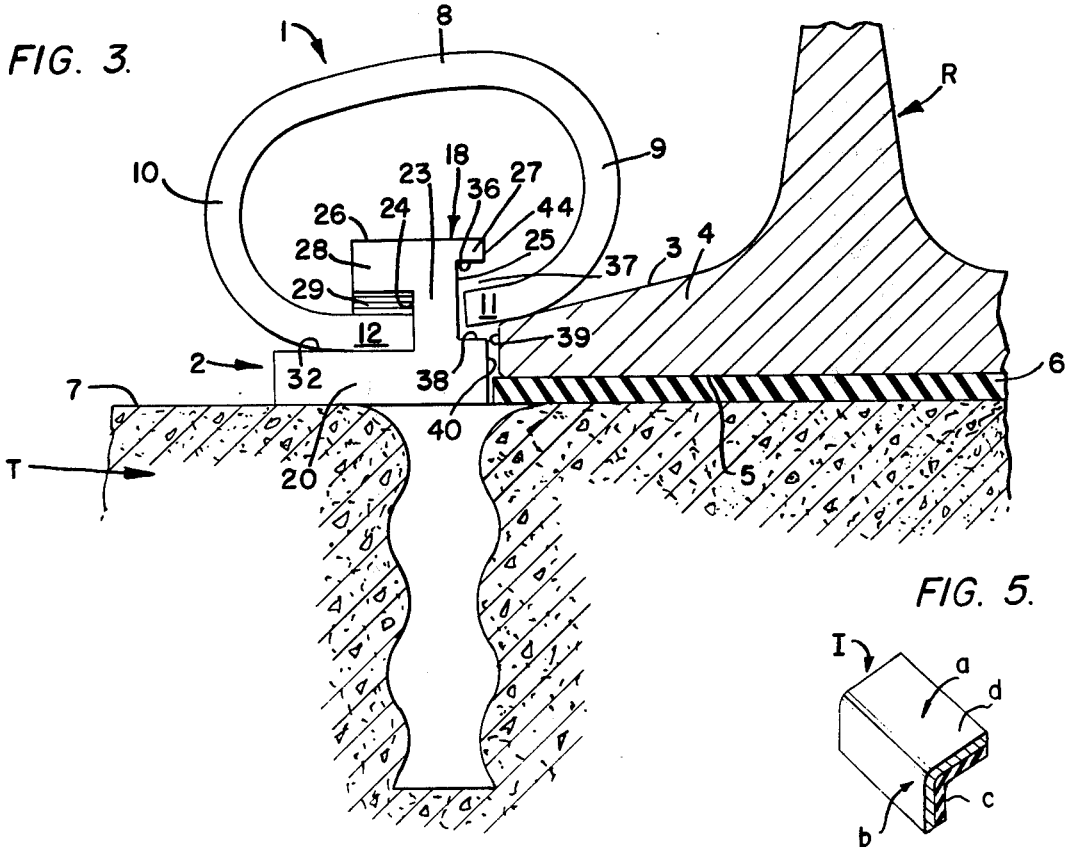
FIG. 5.

RAIL FASTENER

This invention relates generally to railway appliances, and more specifically, to an improved rail fastener for securing railroad rails to crossties constructed either of concrete, plastic, metal or wood.

Rail fasteners according to the present assembly are provided to reduce both longitudinal "creeping" of a rail as well as to inhibit pumping of the crosstie into the road bed ballast as induced by the normal vertical wave motion of the rail during passage of traffic thereover. Another feature of many such rail fasteners is to resist overturning of the rail.

Many efforts have been made to produce rail fasteners intended to accomplish the above related functions. Certain devices such as found in U.S. Pat. No. 3,004,716 issued Oct. 17, 1961, comprise a bent wire or rod member suitably anchored adjacent a rail base flange and including one or more portions overlying the rail flange in a biasing manner. The formation of such a fastener is relatively expensive in view of the elaborate equipment required to produce the numerous bends and curves which must be critically controlled. Even then the resultant fastener lacks fixed means to positively limit rail wave motion and to inhibit rail overturning. Another type of fastener is found in U.S. Pat. No. 1,902,615 issued Mar. 21, 1933, comprising a rigid fixed member secured adjacent the rail base flange and including a portion overlying the rail flange and spaced thereabove. The former referenced patent is representative of a type of rail fastener tending to resist both longitudinal and vertical displacement of a rail, while the latter patent would be understood to limit only the amount of vertical displacement of the rail.

By the present invention a unique arrangement is provided wherein a resilient or deflectable C-shaped clip is constantly biased against a rail base flange to resist both longitudinal and vertical displacement thereof and is retained in its use position by a fixed shoulder or anchor member, including means therein restricting the vertical displacement of that portion of the C-shaped clip engaging the rail base flange whereby positive means is provided to inhibit rail overturning while at the same time allowing of the usual wave motion of the rail during passage of traffic. The present invention further proposes novel means for the ready attachment of the C-shaped clip to the fixed anchor means whereby a camming action is automatically achieved during assembly thereof resulting in a predetermined degree of force or clamping action being applied by that portion of the clip engageable with the rail base flange.

Accordingly, one of the primary objects of the present invention is to provide an improved rail fastener including a spring clip defining a "C" shaped configuration, together with anchor means fixedly securing one arm of the clip while retaining the other arm in a biasing relationship against a rail base flange.

Another object of the present invention is to provide an improved rail fastener including a resilient C-shaped clip longitudinally insertable in fixed anchor means having a tapered groove serving to relatively deflect, in a transverse direction, the two arms of the clip during assembly.

A further object of the present invention is to provide an improved rail fastener including a C-shaped clip insertable in anchor means having a tapered groove receiving one arm of the clip and a channel receiving the other clip arm, and wherein the channel has a vertical height selected to permit limited vertical displacement of the other arm disposed therein.

With these and other objects in view which will more readily appear as the nature of the invention is better understood, the invention consists of the novel construction, combination and arrangement of parts hereinafter more fully described, illustrated and claimed.

Preferred and practical embodiments of the invention are shown in the accompanying drawing, in which:

FIG. 1 is a perspective view of a spring clip according to the present invention;

FIG. 2 is an outside elevation of the shoulder or anchor member of the present invention;

FIG. 3 is a partial end view, partly in section, of a complete rail fastener according to the present invention;

FIG. 4 is a fragmentary end view illustrating a modification of the shoulder member in the present invention.

FIG. 5 is a perspective view of an insulation member which may be used with the rail fastener of the present invention.

Similar reference characters designate corresponding parts throughout the several views of the drawing.

Referring now to the drawing, particularly FIG. 3, the rail fastener of the present invention will be seen to include a spring clip, generally designated 1, attached to a shoulder or anchor member 2 so as to position a portion of the clip in overlying relationship with respect to the top surface 3 of the base flange 4 of a rail R. The rail is illustrated in a typical installation with its bottom surface 5 disposed upon a tie pad 6 which in turn is supported upon the upper surface 7 of a crosstie T. The use of a tie pad and likewise the specific composition of which the crosstie is formed will be understood to be immaterial insofar as the present rail fastener is concerned, yet for purposes of illustration a cast concrete crosstie T is shown.

The construction of the C-clip 1 is most clearly illustrated in FIG. 1 of the drawing wherein it will be seen that the clip 1 includes a unitary, elongated resilient body having a main wall 8 connected to a pair of end walls 9–10 which in turn are joined to a first arm 11 and second arm 12, respectively. Although a circular C-clip conceivably could be utilized in carrying out the present invention, it is preferable that the cross-sectional configuration more closely resembles an oval shape providing a nominal straight section immediately adjacent the distal portion of the two yieldable arms 11 and 12, for reasons which will become obvious hereinafter. When removed from the assembled or use position of FIG. 3, the C-clip 1 will appear in the unstressed at-rest position as shown in FIG. 1 of the drawing wherein it will be noted that the two arms 11 and 12 are disposed in substantially a common plane with their edges 13—13 parallel and opposed to one another and providing a noticeable space 14 therebetween. The C-clip is preferably constructed of steel, thus providing an inherent resilience ensuring its function as described later on. The longitudinal axis 15 thereof need not be any greater than the major transverse axis 16, which latter dimension in turn is preferably greater than the minor transverse axis 17.

Installation of the above described clip is accomplished by assembling the clip as shown in FIG. 3 of the drawing by means of the shoulder or anchor member 2 also illustrated in FIG. 2. This anchor member includes a head, generally designated 18, and which is suitably affixed in a stationary manner so as to be disposed above the plane of the crosstie upper surface 7. In the case of a cast crosstie T as shown in FIG. 3, it will obviously follow that the most ready means of securing the anchor or shoulder head 18 will be by casting in situ during the construction of the crosstie and accordingly the member 2 is disclosed as including a depending stem 19 extending downwardly from the platform 20 of the head 18. The stem 19 comprises a shank 21 preferably provided with peripheral locking means such as the protuberances 22 so as to offer a positive interlocking means when cast within the composition forming the crosstie T.

Quite obviously, if a different crosstie installation is involved alternative means may be provided to ensure positive securing of the head 18 of the member 2 relative the cross-tie. For example, if a wooden crosstie is employed, then appropriate mechanical fasteners such as screws or spikes (not shown) may be passed through the platform 20 into the wooden crosstie and likewise, if a tieplate (not shown) is employed, then the shoulder member 2 can either be attached thereto by means of suitable fasteners or be formed as an integral portion thereof.

The longitudinal extent of the anchor member head 18 as viewed in FIG. 2 of the drawing is preferably no less than the longitudinal axis 15 of the clip 1 and includes a web 23 extending upwardly from the platform 20 and provided with an outer wall 24 facing the field side of the installation and a parallel inner wall 25 facing the gauge side of the installation. The upper limit of the head 18 is defined by a top wall 26 which projects transversely beyond the inner and outer walls of the web to provide an inner flange 27 and an outer flange 28. The undersurface of the outer flange 28 is formed by an inclined wedge surface 29, depending downwardly from the front 30 of the head 18 to the rear 31 thereof as shown most clearly in FIG. 2 of the drawing. The planar inclined wedge surface 29 will thus be seen to form, together with the juxtaposed planar bearing surface 32 of the platform 20, a tapered groove or inclined restriction 33 having a maximum vertical extent at its entrance 34 and a minimum vertical extent at its exit 35. Preferably, the vertical extent of the groove 33 at the exit 35 is no greater than the thickness of the clip second arm 12 for reasons which will become apparent hereinafter.

The inner flange 27, on the gauge side of the anchor member head 18, includes a lower limit defined by a horizontal upper abutment surface 36 and thus forms a horizontally extending longitudinal channel 37 bounded at its lower limit by the lower channel surface 38 of the platform 20. In the embodiment as illustrated in FIG. 3 of the drawing, the vertical extent of this longitudinal channel 35 is substantially greater than the thickness of the clip first arm 11, and more significantly, the plane of the horizontal upper abutment surface 36 of the channel is located at a greater height than at least the exit edge of the inclined wedge surface 29 of the groove 33.

Assembly of the component of the instant rail fastener is achieved by utilizing the above described groove 33 and channel 37 as retaining means for the clip arms 12 and 11, respectively. Following the initial placement of the edge 39 of a rail base flange juxtaposed the inner face 40 of the head 18 of the anchor means 2, the C-clip 1 is attached to the anchor member with the spaced apart edges 13—13 of the two arms 11 and 12 thereof straddling the web 23 of the anchor head 18. During the initial stages of this operation, it will be understood that the distal portions of the transversely resilient arms 11 and 12 are in a common plane and the space 14 therebetween is at least as great as the transverse dimension of the web 23, such that no resistance is encountered when the leading edge surface 41 of the clip arms 11 and 12 first enter the channel 37 and tapered groove 33 adjacent the front 30 of the shoulder head 18. The clip 1 is thereafter urged by any suitable means such as a maul, to advance the clip along its longitudinal axis, whereupon it will be understood that the inner surface 42 of the second arm 12 will engage the inclined surface 29 of the groove 33 such that continued longitudinal displacement of the clip toward the exit 35 of the groove 33 will produce an ever-increasing downward deflection of the second arm 12 until the leading edge surface 41 of the clip 1 has been advanced to a point adjacent the exit 35 of the groove 33.

During the entire foregoing longitudinal displacement of the clip 1, the outer surface 43 of the first arm 11 will be constantly biased, under an ever-increasing stress, as the afore-mentioned downward deflection of the second arm 12 is accomplished and in view of the rigid fixed nature of the top surface 3 of the rail base flange 4, it will thus be understood that only the second arm 12 is capable of being deflected downwardly from its original coplanar relationship with the first arm 11, such that the resultant deflection as illustrated in FIG. 3 is achieved, whereupon it will follow that a substantial downwardly directed force will be applied by the outer surface 43 of the first arm 11 against the top surface 3 of the rail base flange 4.

As shown in FIG. 3, the lower channel surface 38 is preferably disposed in a plane at least slightly below the top surface 3 of the rail base flange such that the outer surface 43 of the first arm 11 will at all times be spaced away from this lower channel surface thereby ensuring that the full biasing action being exerted in a downward direction by the first arm 11 will be directed upon the rail base at all times.

The previously referenced floating action of the present invention will be apparent upon a review of FIG. 3 wherein it will be seen that during vertical undulating wave motion of the rail, the rail base flange 4 and its top surface 3 will be vertically displaced relative the upper surface 7 of the crosstie T, yet in view of the clear space shown between the inner surface 42 of the first arm 11 and the horizontal upper abutment surface 36 of the channel 37, it will follow that such wave motion of the rail may occur only as the first arm 11 is being urged upwardly into the free space against the ever-increasing biasing action being offered by this first arm as the arm is deflected upwardly. The horizontal upper abutment surface 36 of the channel 37 extends inwardly and terminates in an inside edge 44 which at all times overlies the distal edge 13 of the first arm 11 in order to restrict the amount of vertical deflection of the first arm 11 and thereafter inhibit rail overturning when the inner surface 42 of the first arm 11 strikes this abutment surface 36.

The modification shown in FIG. 4 of the drawing relates to an alternate anchor member 2' intended to cooperate with an identical clip as described in the preceding embodiment. This latter construction includes a head 18' wherein the channel 37' is of a lesser vertical extent than the channel 37. This is achieved by lowering the position of the horizontal upper abutment surface 36' to an elevation intended to abut with the inner surface 42 of the clip first arm 11 when fully installed such that a non-floating type of rail fastener is achieved employing a clip 1 functioning the same as in the first described embodiment, with respect to its attachment to the anchor member.

The insulation member I shown in FIG. 5 may be used to provide an alternate arrangement when it is desired to insulate the rail R and/or adapt the present fastener to a smaller rail. The member I comprises an angular device including flanges a and b which preferably are formed with an inner layer c of suitable dielectric material adjacent a steel outer layer d. In use, the member I is installed in the well known manner between the clip and shoulder member and the rail base flange such that the flange a is disposed upon the rail top surface 3 beneath the clip first arm 11 while the flange b is disposed intermediate the rail edge 39 and shoulder member inner face 40.

I claim:

1. A fastener for securing a rail base flange to a crosstie including, anchor means provided with clip retaining means secured atop said crosstie laterally adjacent said rail base flange, a unitary elongated spring clip removeably attached to said anchor means by said retaining means, said spring clip provided with an uppermost main wall having a longitudinal axis parallel to said rail base flange and a pair of substantially symmetrical curved end walls joined to lowermost free arms having substantially opposed distal edges resiliently deflectable vertically and transversely of said longitudinal axis, said pair of arm edges disposed in a substantially parallel spaced-apart relationship, a first one of said arms overlying the top surface of said rail base flange and having its distal edge facing away from said rail base flange and juxtaposed said clip retaining means laterally adjacent said rail base flange, a second one of said arms disposed within and engageable by said clip retaining means, said second arm edge having a vertical thickness of substantially constant extent throughout its length, said retaining means including integral stationary camming means engaging and resiliently deflecting said second clip arm transversely of said longitudinal axis and downwardly below the horizontal plane of said first clip arm, and said camming means includes a tapered groove the entrance of which is of greater height than said second arm edge vertical thickness, whereby, said first clip arm is biased downwardly against said rail base flange top surface to retain said rail base flange upon said crosstie when said second arm edge is longitudinally inserted into said tapered groove.

2. A rail fastener according to claim 1 wherein, said anchor means includes a unitary head having said clip retaining means thereon, said head having a front and rear, and said camming means groove disposed on the field side of said head extending from said front to said rear and parallel to the running length of said rail flange.

3. A rail fastener according to claim 2 wherein, the length of said clip longitudinal axis is at least as long as said camming means groove.

4. A rail fastener according to claim 2 wherein, said anchor head includes a platform atop said crosstie, a web projecting upwardly from said platform, an outer flange extending from the top of said web toward the field side of said head and said groove is disposed between said outer flange and platform.

5. A rail fastener according to claim 4 including, an inner flange extending from the top of said web toward the gauge side of said head, said inner flange spaced above said platform to provide a longitudinally extending channel therebetween and the distal portion of said clip first arm is disposed within said channel.

6. A rail fastener according to claim 5 wherein, said inner flange is disposed at a plane substantially above said clip first arm to provide a free space in said channel above said first arm whereby limited vertical displacement of said rail base flange and first arm may occur before said first arm abuts said inner flange.

7. A rail fastener according to claim 5 wherein, said platform defining the lower limit of said channel is disposed at a plane below that of said rail base flange top surface.

8. A rail fastener according to claim 5 wherein, said groove is of a vertical height adjacent said head rear which is no greater than said vertical thickness of said second arm edge.

9. A rail fastener according to claim 4 wherein, said outer flange includes an inclined undersurface defining the upper limit of said camming means groove.

10. A rail fastener according to claim 4 wherein, said platform includes an upper bearing surface disposed at a plane below that of said rail base flange.

11. A rail fastener according to claim 2 wherein, said groove includes an inclined surface on said head defining the upper limit of said groove.

12. A rail fastener according to claim 2 wherein, said groove is bounded by an upper wedge surface inclined downwardly from said head front to said rear.

13. A rail fastener according to claim 1 wherein, said crosstie comprises a molded composition, said anchor means including a head disposed atop said crosstie and having a depending stem cast within said crosstie.

14. A rail fastener according to claim 1 wherein, said clip arms are normally disposed in a common horizontal plane when said clip is removed from said anchor means.

15. A rail fastener according to claim 1 including, an insulation member having a pair of flanges overlying said rail base intermediate said clip first arm and said anchor means, respectively.

16. A rail fastener according to claim 15 wherein, said insulation member comprises an inner layer of dielectric material and an outer layer of metal.

* * * * *